United States Patent [19]

Erickson

[11] Patent Number: 5,029,434

[45] Date of Patent: Jul. 9, 1991

[54] SADDLE RIDING HARNESS KIT

[76] Inventor: Karen Erickson, RR 7 S23C33 Paterson Rd., Prince George, B.C. V2N2J5, Canada

[21] Appl. No.: 529,560

[22] Filed: May 29, 1990

[51] Int. Cl.[5] ..... B68C 1/00

[52] U.S. Cl. ..... 54/46

[58] Field of Search ..... 54/44, 46; 119/96

[56] References Cited

U.S. PATENT DOCUMENTS 4,840,144 6/1989 Voorhees et al. ..... 119/96
4,848,067 7/1989 Martinsen ..... 54/44

FOREIGN PATENT DOCUMENTS 2655489 6/1978 Fed. Rep. of Germany ..... 119/96
2552065 3/1985 France ..... 54/44

*Primary Examiner*—Robert P. Swiatek
*Attorney, Agent, or Firm*—Leon Gilden

[57] ABSTRACT

An assembly including a flexible vest, including a first harness ring loop positioned about an upper portion of the vest and secured thereto, with a second harness ring loop secured to a lower end of the vest, with the first harness ring loop including a first and second forward vertical belt secured between the first and second harness loops forwardly of the vest, with a first and second rear vertical belt secured to a rear portion of the vest, wherein the first rear and first forward vertical belts are securable overlying the vest, with the second rear and second vertical belts securable together overlying the vest, wherein the first harness ring loop includes a forward and rear support belt securable to forward and rear rings secured to an associated saddle pommel and a saddle seat ridge. Right and left support belts are secured to diametrically opposed side portions of the second harness ring loop securable to a "Y" strap, in turn secured to a "D" ring of an associated saddle. Thigh straps are further utilized securable about each thigh of an individual, and also secured to a "Y" strap mounted to each side of the saddle. A foam cushion insert is provided captured between the rider and the saddle seat to frictionally enhance engagement of the rider with the associated saddle seat.

5 Claims, 4 Drawing Sheets

PRIOR ART

SADDLE RIDING HARNESS KIT

BACKGROUND OF THE INVENTION

1. Field of the Invention

The field of invention relates to saddle harness apparatus, and more particularly pertains to a new and improved saddle riding harness kit for use particularly by individuals of diminished physical capacity to secure such individuals within a saddle permitting such individuals to balance within a saddle seat for riding of an associated horse.

2. Description of the Prior Art

Various saddle accessories have been provided in the prior art to secure an individual to a horse or to a riding vehicle to maintain such an individual in position about a seated position during a riding procedure. Individuals of diminished physical capacity have in the prior art been neglected in a need to properly seat and orient such individuals upon a saddle to permit balancing and riding of an associated horse. Examples of prior art harness assemblies may be found in U.S. Pat. No. 1,397,128 to Keithley wherein saddle attachments are securable to each side of an associated saddle to provide overlying protection to leg portions of a rider.

U.S. Pat. No. 4,799,709 to Francois sets forth a safety harness including a central belt securable about a seat portion of an associated vehicle, with right and left accessory straps securable about the legs of a rider to secure the rider to an associated seat portion.

U.S. Pat. No. 2,128,159 to Morgan sets forth the use of flexible units secured about the thighs of an individual, wherein the units include frictional projections to enhance engagement with a saddle during a riding procedure.

U.S. Pat. No. 558,029 Baur provides a riding saddle safety attachment utilizing a stud button to assist in securement of a rider and the rider's legs to an individual saddle.

U.S. Pat. No. 3,974,669 to Bohlin sets forth a suit arrangement utilizing various loops mounted about the suit to assist in securement of an individual relative to a seat for use in aircraft travel As such, it may be appreciated that there continues to be a need for a new and improved saddle riding harness kit wherein the same addresses both the problems of ease of use, as well as effectiveness in permitting disabled individuals securement and comfort in association with a riding saddle, and in this respect, the present invention substantially fulfills this need.

SUMMARY OF THE INVENTION

In view of the foregoing disadvantages inherent in the known types of saddle harness structures now present in the prior art, the present invention provides a saddle riding harness kit wherein the same secures and positions an individual in a fixed relationship relative to an associated saddle. As such, the general purpose of the present invention, which will be described subsequently in greater detail, is to provide a new and improved saddle riding harness kit which has all the advantages of the prior art saddle harness kit organizations and none of the disadvantages.

To attain this, the present invention provides an assembly including a flexible vest, including a first harness ring loop positioned about an upper portion of the vest and secured thereto, with a second harness ring loop secured to a lower end of the vest, with the first harness ring loop including a first and second forward vertical belt secured between the first and second harness loops forwardly of the vest, with a first and second rear vertical belt secured to a rear portion of the vest, wherein the first rear and first forward vertical belts are securable overlying the vest, with the second rear and second vertical belts securable together overlying the vest, wherein the first harness ring loop includes a forward and rear support belt securable to forward and rear rings secured to an associated saddle pommel and a saddle seat ridge. Right and left support belts are secured to diametrically opposed side portions of the second harness ring loop securable to a "Y" strap, in turn secured to a "D" ring of an associated saddle. Thigh straps are further utilized securable about each thigh of an individual, and also secured to a "Y" strap mounted to each side of the saddle. A foam cushion insert is provided captured between the rider and the saddle seat to frictionally enhance engagement of the rider with the associated saddle seat.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved saddle riding harness kit which has all the advantages of the prior art saddle harness structures and none of the disadvantages.

It is another object of the present invention to provide a new and improved saddle riding harness kit which may be easily and efficiently manufactured and marketed.

It is a further object of the present invention to provide a new and improved saddle riding harness kit which is of a durable and reliable construction.

An even further object of the present invention is to provide a new and improved saddle riding harness kit which is susceptible of a low cost of manufacture with regard to both materials and labor, and which accordingly is then susceptible of low prices of sale to the consuming public, thereby making such saddle riding harness kits economically available to the buying public.

Still yet another object of the present invention is to provide a new and improved saddle riding harness kit which provides in the apparatuses and methods of the prior art some of the advantages thereof, while simultaneously overcoming some of the disadvantages normally associated therewith.

Still another object of the present invention is to provide a new and improved saddle riding harness kit wherein the same fixedly secures a disabled individual in a fixed relationship relative to an associated saddle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
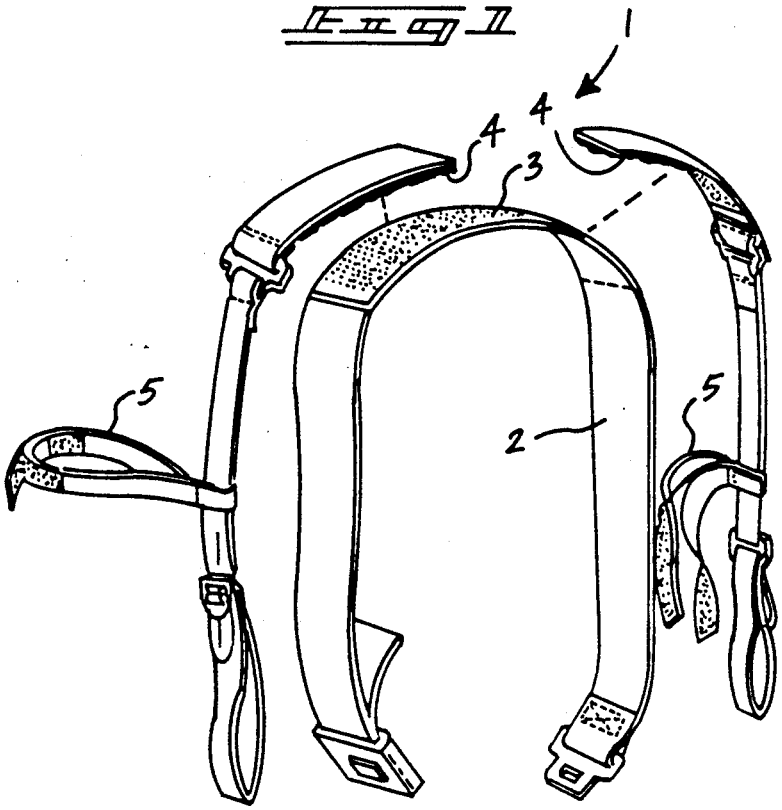
FIG. 1 is an isometric illustration, somewhat exploded, of a prior art rider harness assembly.

With reference now to the drawings, and in particular to FIGS. 1 to 6 thereof, a new and improved saddle riding harness kit embodying the principles and concepts of the present invention and generally designated by the reference numeral 10 will be described.

Figure 2:
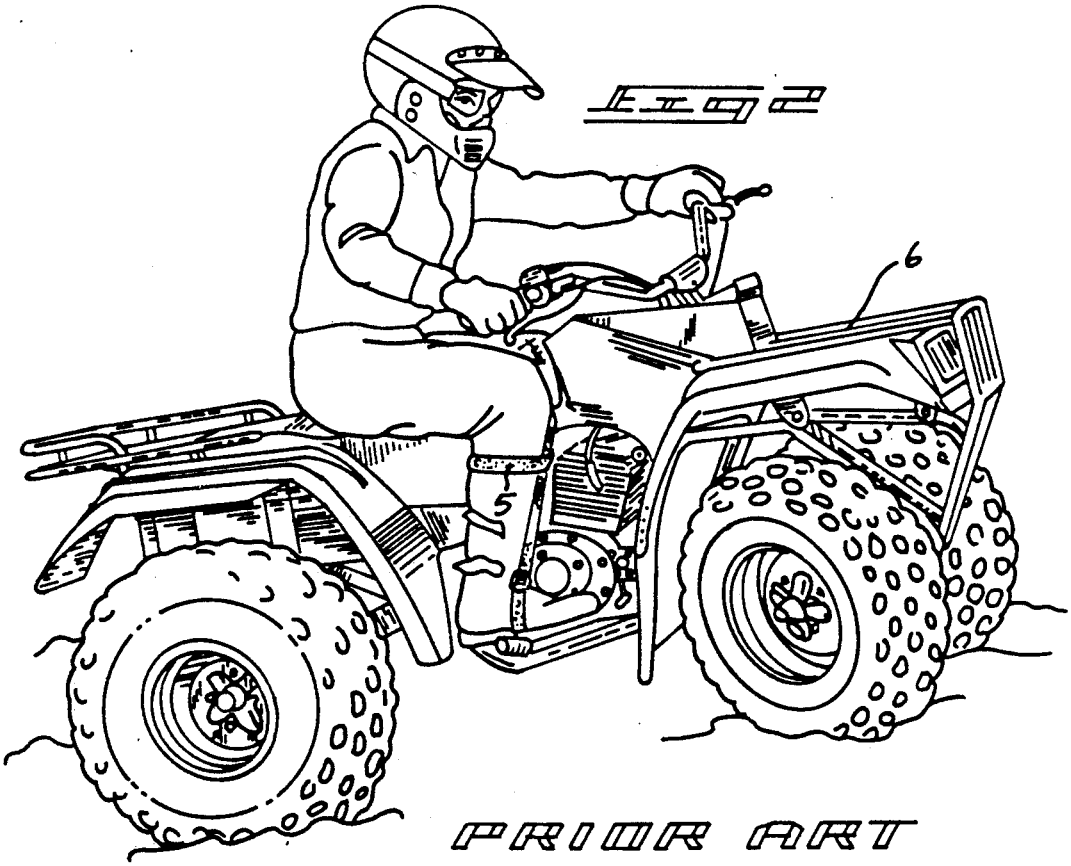
PRIOR ART Fig 2
FIG. 2 is an isometric illustration of the harness assembly, as illustrated in FIG. 1, with an associated rider.

FIG. 1 illustrates a prior art harness assembly 1, wherein a central strap 2 is secured about a seat portion of an associated vehicle 6, as illustrated in FIG. 2, with a hook and loop fastener portion 3 formed at an upper surface thereof in selective association with further hook and loop fastener surfaces 4 mounted to lateral harness which each includes an individual leg strap 5 securable about an individual rider during use.

More specifically, the saddle riding harness kit 10 of the instant invention essentially comprises a first harness ring loop 11 spaced from and parallel to a second harness ring loop 12. The first harness ring loop 11 includes a first buckle end and a first free end, as the second harness ring loop 12 includes a second buckle end and a second free end to permit selective securement of the ring loops together. The first and second ring loops 11 and 12 have fixedly secured thereto a first and a second forward vertical belt 13 and 14 respectively. The vertical belts 13 and 14 are arranged parallel relative to one another and extend from the second ring loop 12 upwardly to and beyond the first ring loop 11 and are fixedly secured to the first ring loop 11. Each first and second vertical belt includes a respective first and second forward vertical belt loop 13*a* and 14*a*. Fixedly mounted to rear surfaces of the first and second ring loops 11 and 12 are a first vertical rear belt 15 and a second rear vertical belt 16, wherein the first and second rear vertical belts are also arranged parallel relative to one another, and each include a respective first rear vertical belt free end 15*a* and a second rear vertical belt 16*a*, wherein the free ends 15*a* and 16*a* are respectively securable to the first and second forward vertical belt loops 13*a* and 14*a* respectively. The first and second rear vertical belts 15 and 16 are mounted to lowermost terminal ends to the second ring loop 12 and extend upwardly and are fixedly secured to the first ring loop 11, and beyond the first ring loops 11 to permit securement to respective vertical belt loops 13*a* and 14*a*.

Figure 4:
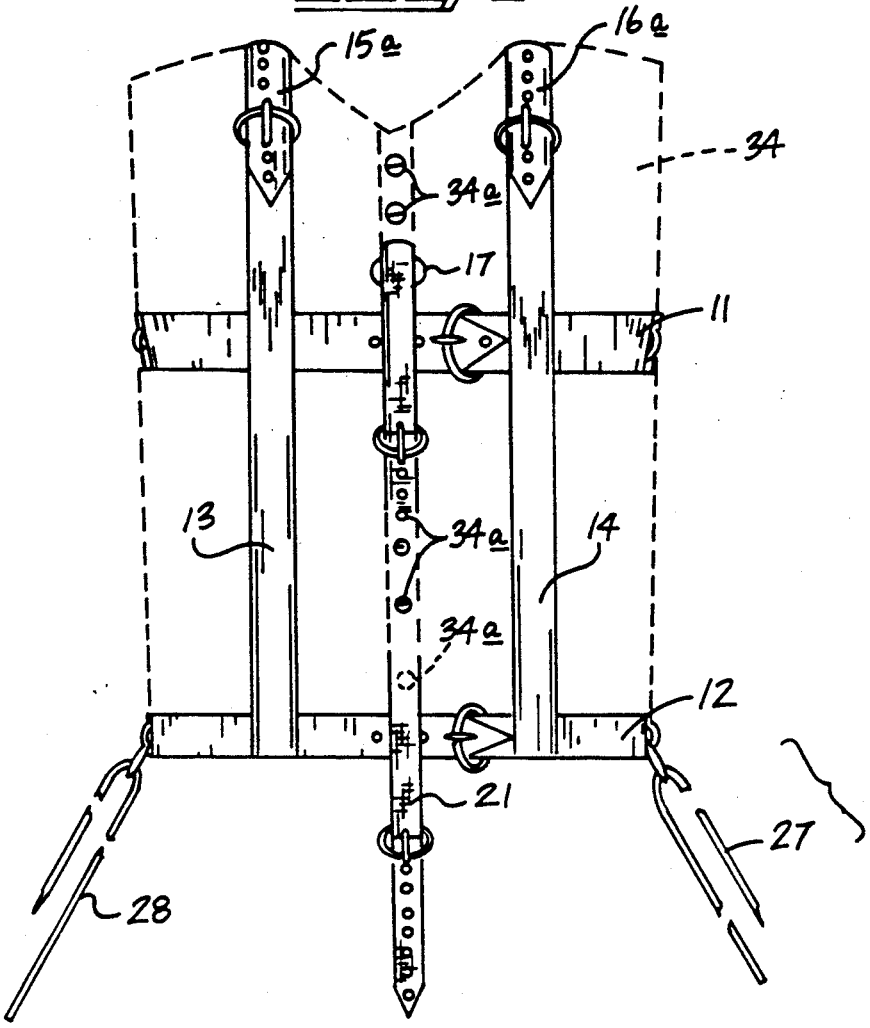
FIG. 4 is an orthographic frontal view, taken in elevation, of the instant invention in fixed association with a vest.
Figure 5:
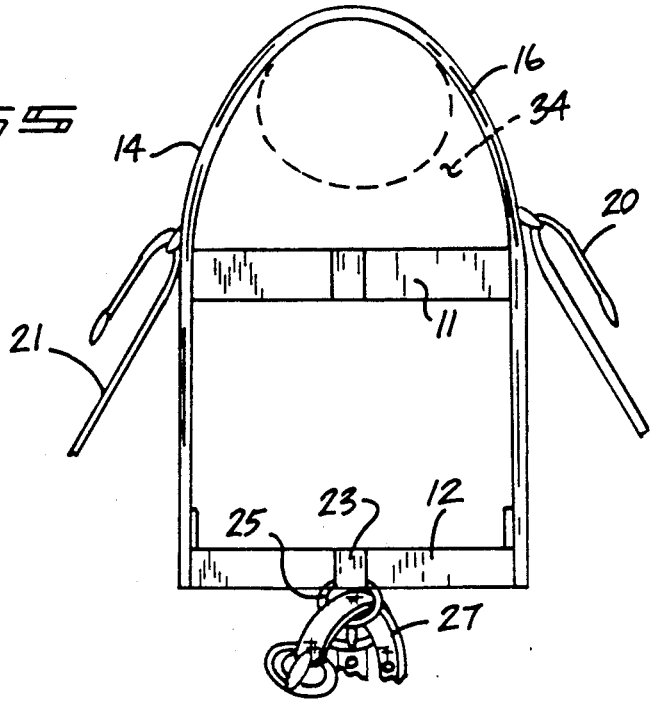
FIG. 5 is an orthographic side view, taken in elevation, of the instant invention as illustrated in FIG. 4.

FIGS. 4 and 5 illustrate the first and second harness ring loops 11 and 12 fixedly mounted to a torso encompassing vest 34. The vest 34 includes a series of vest fasteners 34*a* positioned vertically along a forwardmost portion of the vest spaced medially between the first and second forward vertical belt members 13 and 14, whereupon on fastening of the respective first buckle end and first free end of the first harness ring loop 11 and the second buckle end and the second free end of the second ring loop 12 permits opening of the vest 34 to accommodate an individual therewithin, whereupon the vest fasteners 34, as well as the first and second harness ring loops 11 and 12 are secured together, as well as the first and second rear vertical belt free ends to the first and second forward belt loops, wherein as indicated the first and second vertical belt loops are formed as buckles to permit engagement of the free ends of the rear vertical belts. Further it should be noted that the first and second rear vertical belt free ends 15*a* and 16*a* are not secured to the vest to permit adjustment of the rear vertical belts relative to the forward vertical belts to permit adjustable accommodation of an individual within the vest structure 34.

Figure 6:
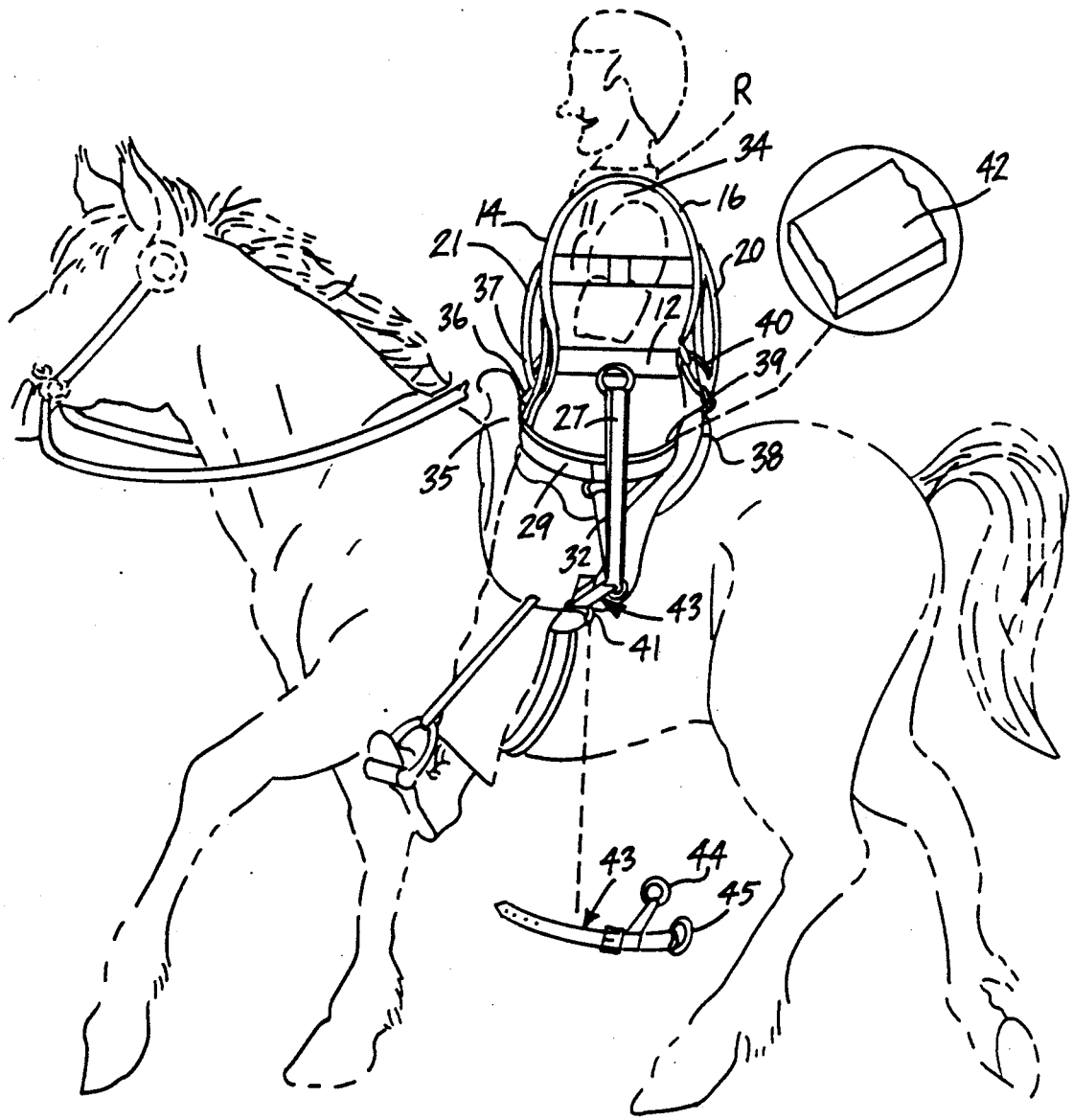
FIG. 6 is an orthographic side view, taken in elevation, of the instant invention in association with the saddle utilized by the instant invention.

A forward ring 17 is mounted adjacent the first free end of the first ring loop 11, with a rear ring 18 mounted medially of the first and second rear vertical belts 15 and 16. The forward and rear rings 17 and 18 include a respective forward and rear ring belt 19 and 20 respectively to secure the forward and rear rings to the first harness ring loop 11. When the first buckle end and the first free end of the first harness ring loop 11 are secured together, the forward ring 17 is positioned medially of the first and second forward vertical belts 13 and 14, as illustrated in FIG. 4, wherein a forward support belt 21, including a buckle and fastener end, is directed slidably through the forward ring belt 19. Comparably, a rear support belt 22 is slidably directed through the rear ring 18. Reference to FIG. 6 illustrates that the forward support belt 21 is secured to a saddle pommel ring 37 that in turn is secured to a saddle pommel strap 36 that is flexible and secures the ring 37 to the saddle pommel 35 of the associated saddle utilized by the instant invention, wherein the saddle further includes a saddle seat ridge 38 positioned rearwardly of the saddle pommel 35 to define a saddle seat therebetween. The saddle seat ridge 38 includes a saddle seat strap 39 that flexibly secures a saddle seat ring 40 to the saddle seat ridge 38. The rear ring belt 20 is accordingly secured to the saddle seat ring 40 thereby provide forward and rear securement of the vest 34 and its associated occupant within the saddle.

Figure 3:
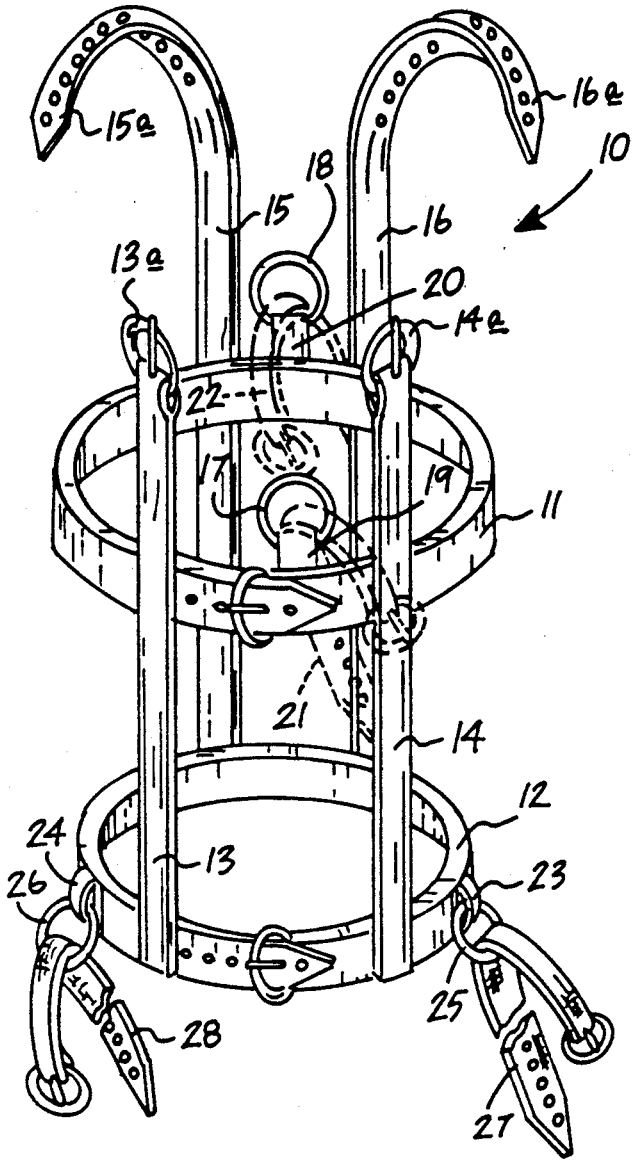
FIG. 3 is an isometric illustration of the instant invention.

References to FIGS. 3 and 4 illustrate that the second harness ring loop 12 includes a respective left and right hip loop 23 and 24 respectively mounted at diametrically opposed portions of an exterior surface of the second harness ring loop 12. Each hip loop 23 and 24 includes a respective left and right hip ring 25 and 26 slidably mounted within each hip loop. Each left and right ring 25 and 26 respectively slidably receives a respective left and right support belt 27 and 28 therethrough, wherein each support belt includes a buckle and a strap member. To secure each left and right support belt 27 and 28 to the associated saddle, the saddle includes a saddle "D" ring 41 positioned adjacent a lowermost end of the saddle seat, wherein the "D" ring secures a "Y" strap 43 securably therethrough, wherein the "Y" strap includes a buckle and free end to secure the "Y" strap within the "D" ring. The "Y" strap 43 includes a plurality of legs that mount a first and second ring 44 and 45 respectively thereto. Each side of the saddle includes a "Y" strap, but for purposes of illustration, it is deemed that discussion of one of such sides is sufficient as each are of identical construction. The second ring 45 receives the left support belt therethrough, wherein in a comparable manner, a "Y" strap on the right side of the saddle will secure the right support belt 28 in a second ring.

Figure 3A:
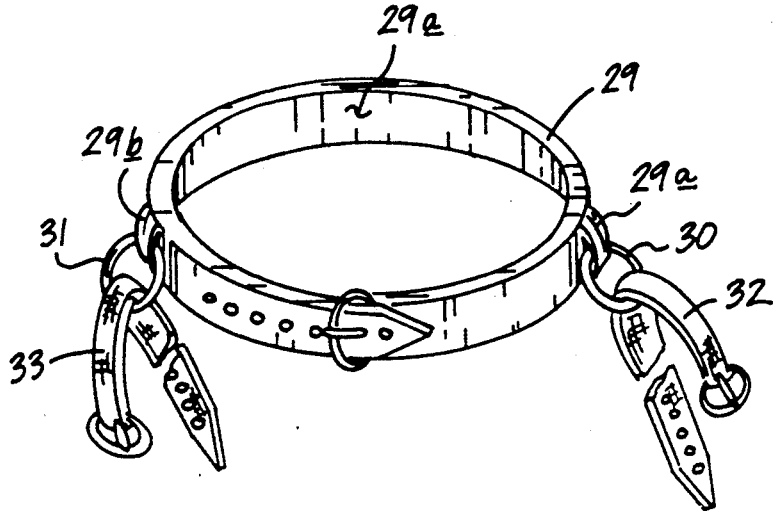
FIG. 3*a* is an isometric illustration of one of a plurality of thigh structures utilized by the instant invention.

The first ring 44 of the "Y" strap is utilized for reception of tension belts, to be discussed. FIG. 3*a* illustrates a thigh strap 29 formed with a free end and a buckle end, and including a first thigh strap ring 30 and a second thigh strap ring 31 mounted on diametrically opposed sides of the thigh strap 29 slidably received within respective first and second thigh strap loops 29*a* and 29*b*. The first thigh strap ring 30 receives a first thigh strap tension belt 32, while the second thigh strap ring 31 receives a second thigh strap tension belt 33. The thigh straps are directed underlying the leg of the rider "R" as illustrated, and are secured within the first ring 44 of the "Y" strap 43 utilizing the buckle fastening members of the tension belts 32 and 33. In this manner, positioning a thigh strap on each leg of the rider "R" enhances securement of the rider within the associated saddle.

Further, a foam cushion 42 of a generally parallelepiped configuration is mounted upon the saddle seat to receive the rider "R" thereon to enhance frictional engagement of the rider "R" with the saddle seat.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as being new and desired to be protected by Letters Patent of the United States is as follows:

1. A saddle riding harness kit comprising, in combination, a torso encompassing vest, the vest including a series of vertically aligned fasteners directed through a forward portion of the vest, and a first harness ring loop fixedly secured to the vest, including a first buckle end and a first free end overlying the forward portion of the vest, and a second harness ring loop secured to the vest adjacent a lower terminal end of the vest and spaced below the first harness ring loop, wherein the second harness ring loop includes a second buckle end and a second free end underlying and aligned with the first buckle free end and the first buckle end, and the first harness ring loop including a forward support belt secured to the first harness ring loop overlying the forward portion of the vest, and a rear support belt mounted to the first harness ring loop overlying a rear portion of the vest, and the second harness ring loop including a right support belt positioned medially of the forward support belt and the rear support belt, and a left support belt positioned medially of the forward support belt and the rear support belt, wherein the left and right support belts are spaced at opposed portions of the second harness ring loop, and including a saddle, wherein the saddle includes a pommel ring mounted to a forward portion of the saddle, and a saddle seat ring mounted to a rear portion of the saddle spaced from the forward portion of the saddle, wherein the forward support belt is selectively securable to the pommel ring and the rear support belt is selectively and securably mounted to the saddle seat ring.

2. A kit as set forth in claim 1 including a "D" ring mounted to the saddle adjacent a lower terminal end of the saddle positioned medially of a saddle seat defined between the pommel ring and the saddle seat ring, and said "D" ring mounted on each side of the saddle including a left side of the saddle and a right side of the saddle, to define a left "D" ring and a right "D" ring respectively, and a first "Y" strap mounted to the left "D" ring and a second "Y" strap mounted to the right "D" ring, each "Y" strap including at least a first ring, the first ring of each "Y" strap receiving a respective left support belt and a right support belt respectively thereto.

3. A kit as set forth in claim 2 wherein each "Y" strap includes a second ring, and at least a left thigh strap mounted about a left thigh of a rider, wherein the thigh strap includes a first thigh strap tension belt and a second thigh strap tension belt, the first and second thigh strap tension belts securable to the second ring of the "Y" strap.

4. A kit as set forth in claim 3 including a first forward vertical belt mounted to the second ring loop and the first ring loop extending above the second ring loop, and a second forward vertical belt mounted to the second ring loop and the first ring loop spaced above the second ring loop, and each first and second forward vertical belt including a respective first and second forward vertical belt loop, and each first and second vertical belt mounted overlying the forward portion of the vest, wherein the vest fasteners are positioned medially of the first and second forward vertical belts, and a first and second rear vertical belt mounted to the rear portion of the vest, the first and second rear vertical belts each mounted to the first and second harness ring loops and extending beyond and above the first and second harness ring loops, and each first and second vertical belt including a first and second vertical belt free end, and the first rear vertical belt free end selectively securable to the first forward vertical belt loop, and the second rear vertical belt free end selectively securable to the second forward vertical belt loop overlying a top portion of the vest.

5. A kit as set forth in claim 4 further including a foam cushion positionable on the seat between the pommel ring and the saddle seat ring.

* * * * *